United States Patent [19]

Sumi

[11] Patent Number: 4,909,200

[45] Date of Patent: Mar. 20, 1990

[54] COMBINED MANUAL AND POWER DRIVEN ENGINE STARTER

[75] Inventor: Kiyohide Sumi, Tokyo, Japan

[73] Assignee: Fuji Jukogyo Kabushiki Kaisha, Tokyo, Japan

[21] Appl. No.: 263,252

[22] Filed: Oct. 27, 1988

[30] Foreign Application Priority Data

Oct. 30, 1987 [JP] Japan ..... 62-277043

[51] Int. Cl.[4] ..... F02N 3/02; F02N 11/00; F02N 17/00

[52] U.S. Cl. ..... 123/179 P; 74/6; 123/179 SE; 475/4

[58] Field of Search ..... 74/6, 625, 626, 801, 74/785; 123/179 P, 179 SE, 185 A, 185 B, 185 BA

[56] References Cited

U.S. PATENT DOCUMENTS

| | | | |
|---|---|---|---|
| 3,537,436 | 11/1970 | Heisler | 123/179 SE |
| 3,596,647 | 8/1971 | Heisler | 123/179 SE |
| 3,696,593 | 10/1972 | Thorud et al. | 123/179 SE X |
| 4,157,083 | 6/1979 | Smith et al. | 74/625 X |
| 4,615,311 | 10/1986 | Scheckel | 123/179 P |
| 4,791,833 | 12/1988 | Sakai et al. | 74/785 X |

FOREIGN PATENT DOCUMENTS

| | | |
|---|---|---|
| 57-55969 | 12/1982 | Japan . |
| 58-108239 | 7/1983 | Japan . |
| 59-56377 | 4/1984 | Japan . |

*Primary Examiner*—Allan D. Herrmann
*Attorney, Agent, or Firm*—Beveridge, DeGrandi & Weilacher

[57] ABSTRACT

A starter for a general purpose engine has a starting motor with an armature shaft disposed in axial alignment with the engine crankshaft. The armature shaft is coupled via a planetary gear set to an intermediate shaft, also in axial alignment with the engine crankshaft, which is coupled to the engine crankshaft via an overrunning clutch. This clutch permits the engine crankshaft to overrun the intermediate shaft after the engine is started. Having a pull rope wound thereon, a starting reel is rotatably and coaxially supported over the intermediate shaft. A centrifugal clutch normally holds the starting reel disconnected from the engine crankshaft and, upon rotation of the starting reel as a result of exertion of a manual pull on the pull rope, drivingly connects the starting reel to the engine crankshaft. Thus the engine may be started either by the starting motor via the intermediate shaft, with the starting reel disconnected from the crankshaft by the centrifugal clutch, or by the manual starting reel, with the starting motor held out of rotation by the overrunning clutch.

12 Claims, 2 Drawing Sheets

COMBINED MANUAL AND POWER DRIVEN ENGINE STARTER

BACKGROUND OF THE INVENTION

This invention relates to engine starters in general and, in particular, to an engine starter of the hybrid type comprising both an electric motor and a hand reel which lend themselves to selective use for power starting or manual starting of the engine. The engine starter in accordance with the invention finds a typical application to general purpose engines.

Both manual and motor driven starters have been suggested and used extensively for cranking general purpose engines. Japanese Laid Open Utility Model Application No. 59-56377 discloses an example of a motor driven starter. It comprises an electric starting motor having its armature shaft geared to an engine crankshaft via an overrunning clutch. An objection to this known power starter is that it becomes totally inoperable in the event of a failure of the battery which is normally employed for powering the starting motor.

This inconvenience is absent from manual starters, an example of which is found in Japanese Utility Model Publication No. 57-55969. This prior art manual starter has a starting reel, with a pull rope wound thereon, which is coupled to a flywheel on an engine crankshaft via an automatic clutch. Upon exertion of a pull on the pull rope the automatic clutch will engage to transmit the rotation of the starting reel to the engine crankshaft. Although practically trouble free, the manual starter is inherently objectionable because of the manual labor involved.

An obvious solution to the problem of how to preclude the weaknesses of both types of starters is to provide a hybrid device comprising both a starting motor and a starting reel, so that the engine may be started either by power cranking or by hand cranking. This concept is itself not new but is embodied, for example, in the device described and claimed in Japanese Laid Open Utility Model Application No. 58-108239. This prior art device is unsatisfactory, however, because of its large bulk resulting from the totally independent connection of the power cranking mechanism and the manual cranking mechanism to the engine crankshaft.

SUMMARY OF THE INVENTION

The present invention materially simplifies the construction, and reduces the size, of engine starters of the type comprising both an electric motor and a hand reel for selective power of manual starting of engines.

Stated in brief, the invention provides a combined manual and power driven engine starter comprising both an electric starting motor and a starting reel, with a rope or like elongate flexible pull member wound on the reel, which may be selectively employed for imparting rotation to an engine drive shaft such as the crankshaft of a reciprocating piston engine. The starting motor has an armature shaft disposed in axial alignment with the engine drive shaft. Coaxially disposed between the motor armature shaft and the engine drive shaft, an intermediate shaft is coupled to the former via speed reduction means such as a planetary gear train and to the latter via an overrunning clutch. The intermediate shaft is driven in a predetermined direction by the starting motor via the speed reduction means for starting the engine via the overrunning clutch.

The starting reel, on the other hand, is rotatably supported over the intermediate shaft in coaxial relation thereto. The pull rope or the like on the starting reel may be pulled manually for driving the starting reel in the same direction as the intermediate shaft. Also included is a clutch means, preferably a centrifugal or like automatic clutch, for holding the starting reel disconnected from the engine drive shaft during the operation of the starting motor and for drivingly connecting the starting reel to the engine drive shaft when the starting reel is manually driven in the predetermined direction.

Thus, for power starting of the engine, the starting motor may be excited from a suitable power supply such as battery. The consequent rotation of the motor armature shaft in the predetermined direction will be transmitted via the speed reduction means to the intermediate shaft and thence to the engine drive shaft via the overrunning clutch. After the engine starts, the overrunning clutch will allow the engine drive shaft to overrun the intermediate shaft and, in consequence, the motor armature shaft. The starting reel will be held disconnected from the engine drive shaft by the automatic clutch means during such power cranking of the engine.

For manual starting, a pull may be exerted on the pull member wound on the starting reel. With the consequent rotation of the starting reel in the predetermined direction, the automatic clutch will engage to transmit the reel rotation to the engine drive shaft. The motor armature shaft and the intermediate shaft will then be both held out of rotation by the overrunning clutch. The automatic clutch will disengage when the starting reel goes out of rotation, allowing the engine drive shaft to rotate independently of the starting reel after the engine starts.

It is to be noted that in the improved engine starter of the invention, the motor armature shaft, intermediate shaft, and engine drive shaft are all in line, and the starting reel is also coaxially supported over the intermediate shaft. The space requirement of the device is thus reduced to a minimum, so that it can be compactly mounted to an existing general purpose engine without any substantial alteration of its construction.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
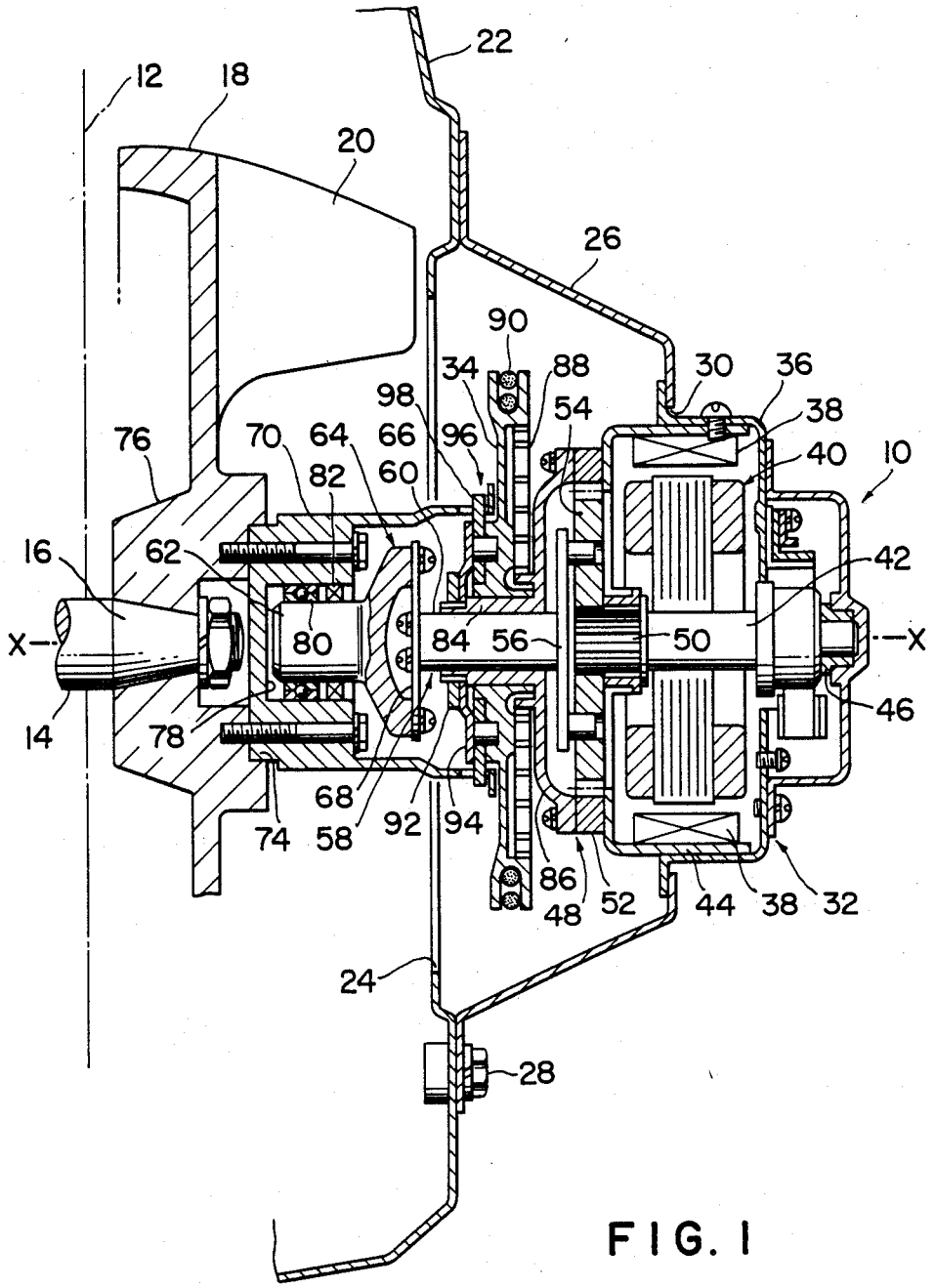
FIG. 1 is an axial section through the combined manual and power driven engine starter constructed in accordance with the invention, the engine starter being shown mounted in position on the flywheel housing of an engine and coupled to its crankshaft.

The representative engine starter in accordance with the invention is generally designated 10 in FIG. 1 and therein shown mounted in place on a general purpose engine of the reciprocating piston type having a crankcase 12 with a crankshaft 14 extending outwardly therefrom. The crankshaft 14 represents an example of an engine drive shaft to which the engine starter of this invention may be coupled for starting the engine.

Mounted fast on the tapered end 16 of the crankshaft 14 is a flywheel 18 which, in this embodiment, is bladed as at 20 to serve the additional purpose of cooling fan. The flywheel 18 is enclosed in a sheet metal flywheel housing 22 which is secured to the crankcase 12 as well as to the engine cylinder block, not shown, which is joined to the crankcase. The flywheel housing 22 serves to direct the cooling air, created by the flywheel 18, into the unshown cylinder block and other parts of the engine. The flywheel housing 22 has formed therein a relatively large diameter hole 24 which is centered about the axis X—X of the engine crankshaft 14. A starter cover 26 is fastened by a bolt 28 to the outside, shown directed to the right in FIG. 1, of the flywheel housing 22 so as to cover the hole 24 and enclose part of the engine starter 10. The starter cover 26 also has defined therein a hole 30 centered about the crankshaft axis X—X and serves also as stationary support means for the engine starter 10.

Largely enclosed by the flywheel housing 22 and starter cover 26, the engine starter 10 is coupled to the flywheel 18 for cranking the engine. The engine starter 10 comprises both an electric starting motor 32 and a hand driven starting reel 34 for selective power and manual cranking.

The starting motor 32 has a motor housing 36 secured to the starter cover 26 so as to partly protrude outwardly therefrom. Within the motor housing 36 there are conventionally provided a set of field windings 38, an armature 40 and a motor armature shaft 42. The field windings 38 are secured to a starting motor yoke 44 which in turn is fastened to the motor housing 36. Surrounded by the field windings 38, the armature 40 is mounted on the armature shaft 42 for joint rotation therewith. The outer or right hand end, as seen in FIG. 1, of the armature shaft 42 is rotatably journaled in a plain bearing 46. The armature shaft 42 is aligned about the axis X—X of the engine crankshaft 14. As the field windings 38 are excited from a suitable power supply such as a battery, not shown, the armature shaft 42 will rotate in a prescribed direction for cranking the engine.

For decreasing the output speed, and hence increasing the output torque, of the starting motor 32 there is provided a planetary gear set 48 in this particular embodiment.

Figure 2:
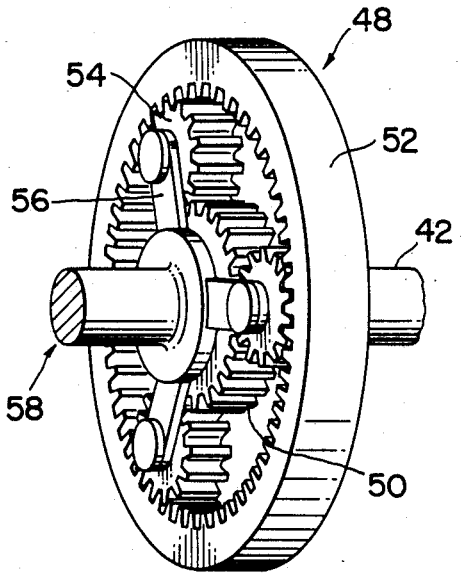
FIG. 2 is a perspective view of the planetary gear train included in the engine starter of FIG. 1.

As will be seen also from FIG. 2, the planetary gear set 48 comprises a sun gear 50 splinedly mounted on the motor armature shaft 42 for joint rotation therewith, an internal or ring gear 52 secured to the starting motor yoke 44, and planet gears 54 rotatably engaged between sun gear 50 and internal gear 52. The planet gears 54 are all rotatably supported by a planet carrier 56 which is formed in one piece with an intermediate shaft 58 rotatable about the crankshaft axis X—X.

Since the internal gear 52 is locked against rotation, the planetary gear set 48 will impart the rotation of the motor armature shaft 42 to the intermediate shaft 58 via the sun gear 50, planet gears 54 and planet carrier 56. The direction of rotation will not change from motor armature shaft 42 to intermediate shaft 58.

In this particular embodiment the intermediate shaft 58 is shown transversely split into a first section 60 and a second section 62, although the intermediate shaft could be of one piece construction. The first section 60 is integral with the planet carrier 56. The two sections 60 and 62 of the intermediate shaft 58 are joined end to end via a flexible coupling 64 in order to allow for possible misalignment between engine crankshaft 14 and motor armature shaft 42.

The flexible coupling 64 comprises a skirt 66 formed on one end of the second intermediate shaft section 62, and a flexible disc 68 secured to the skirt. The first intermediate shaft section 60 is fastened endwise to the flexible disc 68. It is thus seen that the flexible coupling 64 rigidly interconnects the two intermediate shaft sections 60 and 62 as far as the transmission of rotation from one to the other is concerned. It will also be understood that the skirt 66 could be formed on the first intermediate shaft section 60.

Loosely and coaxially surrounding the intermediate shaft sections 60 and 62 and the flexible coupling 64 therebetween, a drive sleeve 70 has an open end oriented toward the starting motor 32 and a closed end 74 screwed or otherwise affixed to the hub 76 of the flywheel 18. The closed end 74 of the drive sleeve 70 has a coaxial recess 78 in which the second intermediate shaft section 62 is engaged via an overrunning clutch 80. An oil seal 82 is also mounted in the recess 78 exteriorly of the overrunning clutch 80.

The overrunning clutch 80 is per se well known in the art, transmitting the predetermined direction of rotation of the motor armature shaft 42, and hence of the intermediate shaft 58, to the engine crankshaft 14 during power cranking of the engine. After the engine has started, however, the overrunning clutch 80 allows the engine crankshaft 14 to rotate independently of, or overrun, the intermediate shaft 58.

For manual cranking of the engine, on the other hand, the starting reel 34 is rotatably and coaxially mounted on a hollow shaft or support sleeve 84 which is fitted over the first section 60 of the intermediate shaft 58 so as to permit its rotation. The support sleeve 84 has an integral flange 86 which is peripherally fastened to the starting motor yoke 44 via the internal gear 52. A return spring 88, preferably in the form of a spiral spring, is mounted between starting reel 34 and support sleeve 84, biasing the starting reel in a direction opposite to the predetermined direction of rotation of the motor armature shaft 42. A pull rope 90 or like elongate flexible member is wound at least in part on the starting reel 34 and partly extends outwardly of the starter cover 26.

Seen at 92 is a locknut fitted over the support sleeve 84. The locknut 92 coacts with a friction washer 94 for restraining the starting reel 34 from detachment from over the support sleeve 84 while permitting the starting reel to rotate relative to the support sleeve.

Thus, upon exertion of a pull on the pull rope 90, the starting reel 34 will spin over the support sleeve 84 in the same direction as the motor armature shaft 42. This rotation of the starting reel is to be imparted to the engine crankshaft 14 as in the following.

It is the drive sleeve 70 that transmits the rotation of the starting reel 34 to the engine crankshaft 14. However, since the starting reel 34 must also be held disconnected from the engine crankshaft after the engine has started or when the engine is being cranked by the starting motor 32, a clutch 96 is provided for coupling the starting reel 34 to the drive sleeve 70 only during the manual cranking of the engine by the starting reel 34.

The clutch 96 is herein shown as an automatic or centrifugal clutch comprising a plurality of centrifugal weights 98 pivotally coupled to one side of the starting reel 34. These weights are to be centrifugally flung into driving engagement with the drive sleeve 70 upon forced rotation of the starting reel 34. The noted friction washer 94 serves the additional purpose of slidably retaining the centrifugal weights 98 in place on the starting reel 34.

OPERATION

First, for the power cranking of the engine, the field windings 38 of the starting motor 32 may be excited with current from the unshown battery or like power supply. The motor armature shaft 42 with the armature 40 thereon will then be set into rotation in the predetermined direction.

The motor armature shaft 42 is coupled directly to the sun gear 50 of the planetary gear set 48. Therefore, with the joint rotation of the sun gear 50 with the motor armature shaft 42, the internal gear 52 of the planetary gear set 48 will constrain the planet gears 54 to revolution about the crankshaft axis X—X in the same direction as the motor armature shaft. This revolution of the planet gears 54 will be imparted to the first section 60 of the intermediate shaft 58 via the planet carrier 56.

The rotation of the first intermediate shaft section 60 will then be imparted to the engine crankshaft 14 via the flexible coupling 64, second intermediate shaft section 62, overrunning clutch 80, and flywheel 18. The starting motor 32 may be deenergized after the engine has started. As the engine crankshaft 14 picks up speed, the overrunning clutch 80 will isolate the rotation of the engine crankshaft, and of the flywheel 18 mounted fast thereon, from the intermediate shaft 58 and the other rotary parts coupled thereto.

The drive sleeve 70 will rotate with the engine crankshaft 14 during such power cranking of the engine. However, being held disconnected from the drive sleeve by the centrifugal clutch 96, the starting reel 34 will remain out of rotation.

The staring motor 32 is mounted to the flywheel housing 22 via the starter cover 26 in the illustrated embodiment. Being both of sheet metal, the flywheel housing 22 and starter cover 26 are relatively low in rigidity. Consequently, in practice, the motor armature shaft 42 may be misaligned with the engine crankshaft 14. Such misalignment will present no serious problem at all in power transmission from motor armature shaft to engine crankshaft as the flexible coupling 64 is connected between the two sections 60 and 62 into which the intermediate shaft 58 is split. Moreover, the direct mounting of the engine starter 10 to the flywheel housing 22 is preferable because the engine crankcase 12 needs no modification in construction for supporting the engine starter.

For manual cranking, a pull may be exerted on the rope 90 wound on the starting reel 34. The starting reel 34 will then rotate against the force of the return spring 88 in the same direction as the predetermined direction of rotation of the starting motor 32. With such rotation of the starting reel 34 the centrifugal weights 98 thereon will be centrifugally flung into driving engagement with the open end of the drive sleeve 70. The resulting rotation of this drive sleeve will be imparted to the engine crankshaft 14 via the flywheel 18 thereby cranking the engine.

When the starting reel 34 goes out of rotation after the exertion of a manual pull on the pull rope 90, the centrifugal weights 98 will come out of engagement with the drive sleeve 70. Only the drive sleeve 70 will then rotate with the engine crankshaft 14 if the engine has started. The pull rope 90 when released will be rewound on the starting reel 34 as the latter rotates in the opposite direction under the bias of the return spring 88.

During such normal cranking, too, the overrunning clutch 80 will function to allow the engine crankshaft 14 to rotate independently of the intermediate shaft 58. The starting motor 32 will therefore remain out of rotation in the face of the forced rotation of the engine crankshaft 14.

It is understood that the above described embodiment is by way of example only and not to impose limitations upon the invention. A variety of modifications or alterations may be made in the details of the foregoing disclosure to conform to the requirements of each specific application of the invention or to design preferences without departing from the scope of the invention.

What is claimed is:

1. A combined manual and power driven starting device for an engine having an engine drive shaft, comprising:

a starting motor having a motor armature shaft disposed in axial alignment with the engine drive shaft;

an intermediate shaft disposed between the motor armature shaft and the engine drive shaft in axial alignment therewith;

wherein the intermediate shaft is divided into a first section coupled to the motor armature shaft and a second section coupled to the engine drive shaft;

speed reduction means connected between the motor armature shaft and the intermediate shaft for transmitting the rotation of the former to the latter at reduced speed, the intermediate shaft being driven in a predetermined direction by the starting motor via the speed reduction means for starting the engine;

overrunning clutch means connected between the intermediate shaft and the engine drive shaft for transmitting the rotation of the former to the latter and for permitting the engine drive shaft to overrun the intermediate shaft after the engine starts;

a starting reel rotatably supported over the intermediate shaft in coaxial relation thereto and having an elongate flexible pull member wound thereon for manually driving the starting reel in the same direction as the intermediate shaft; and second clutch means for holding the starting reel disconnected from the engine drive shaft during the operation of the starting motor and for drivingly connecting the starting reel to the engine drive shaft when the starting reel is manually driven in the predetermined direction.

2. The engine starting device of claim 1 wherein the device further comprises a flexible coupling interconnecting the first and second sections of the intermediate shaft end to end to allow for some misalignment therebetween.

3. The engine starting device of claim 2 wherein the flexible coupling comprises:

a skirt formed on one end of either of the first and second sections of the intermediate shaft; and a flexible disc secured to the skirt;

the other of the first and second sections of the intermediate shaft being secured endwise to the flexible disc.

4. The engine starting device of claim 1 wherein the speed reduction means comprises a planetary gear set.

5. The engine starting device of claim 1 wherein the clutch means comprises:

a drive sleeve coaxially surrounding the intermediate shaft so as to permit the independent rotation thereof and secured to the engine drive shaft for joint rotation therewith; and an automatic clutch acting between the starting reel and the drive sleeve for normally holding the starting reel disconnected from the drive sleeve and for drivingly connecting the starting reel to the drive sleeve when the starting reel is manually driven in the predetermined direction.

6. The engine starting device of claim 5 wherein the automatic clutch is a centrifugal clutch comprising a plurality of centrifugal weights coupled to the starting reel so as to be centrifugally flung into driving engagement with the drive sleeve upon rotation of the starting reel.

7. A combined manual and power driven starting device for an engine having a crankshaft with a flywheel rigidly mounted thereon, and a flywheel housing enclosing the flywheel, the starting device comprising:

support means on the flywheel housing;

a starting motor supported by the support means and having an armature shaft disposed in axial alignment with the engine crankshaft;

an intermediate shaft coaxially disposed between the motor armature shaft and the engine crankshaft;

a planetary gear set connected between the motor armature shaft and the intermediate shaft for transmitting the rotation of the former to the latter at reduced speed, the intermediate shaft being driven in a predetermined direction by the starting motor via the planetary gear set for starting the engine;

an overrunning clutch connected between the intermediate shaft and the engine crankshaft for transmitting the rotation of the former to the latter and for permitting the engine crankshaft to overrun the intermediate shaft after the engine starts;

a starting reel rotatably and coaxially supported between the planetary gear set and the flywheel and having an elongate flexible pull member wound thereon for manually driving the starting reel in the same direction as the intermediate shaft;

clutch means for holding the starting reel disconnected from the engine crankshaft during the operation of the starting motor and for drivingly connecting the starting reel to the engine crankshaft when the starting reel is manually driven in the predetermined direction; and a hollow shaft provided to rotatably support the starting reel, for securing to the support means and for sleeving on the intermediate shaft so as to permit rotation thereof.

8. The engine starting device of claim 7 wherein the planetary gear set comprises:

a sun gear connected to the motor armature shaft for joint rotation therewith;

an internal gear secured to the support means;

a plurality of planet gears meshing with both the sun gear and the internal gear; and a planet carrier rotatably carrying the planet gears and drivingly coupled to the intermediate shaft.

9. The engine starting device of claim 7 wherein the starting reel is rotatably mounted on a hollow shaft which is secured to the support means and which is sleeved on the intermediate shaft so as to permit rotation thereof.

10. The engine starting device of claim 7 wherein the clutch means comprises:

a drive sleeve coaxially surrounding the intermediate shaft so as to permit independent rotation whereof and secured to the flywheel for joint rotation therewith and with the engine crankshaft; and an automatic clutch acting between the starting reel and the drive sleeve for normally holding the starting reel disconnected from the drive sleeve and for drivingly connecting the starting reel to the drive sleeve when the starting reel is manually driven in the predetermined direction.

11. The engine starting device of claim 10 wherein the overrunning clutch is mounted between the intermediate shaft and the drive sleeve.

12. The engine starting device of claim 10 wherein said starting reel comprises a plurality of centrifugal weights so as to be centrifugally flung into driving engagement with the drive sleeve upon rotation of the starting reel.

* * * * *